US008682227B2

(12) United States Patent
Ohgoshi et al.

(10) Patent No.: US 8,682,227 B2
(45) Date of Patent: Mar. 25, 2014

(54) TONER DISCHARGING DEVICE, TONER CARTRIDGE AND IMAGE FORMING APPARATUS

(75) Inventors: Toshihide Ohgoshi, Osaka (JP); Takafumi Nagai, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 41 days.

(21) Appl. No.: 13/538,008

(22) Filed: Jun. 29, 2012

(65) Prior Publication Data

US 2013/0011164 A1 Jan. 10, 2013

(30) Foreign Application Priority Data

Jul. 8, 2011 (JP) ..... 2011-152045

(51) Int. Cl.
*G03G 15/08* (2006.01)

(52) U.S. Cl.
USPC ..... 399/258; 399/263

(58) Field of Classification Search
USPC ..... 399/258, 260, 263
See application file for complete search history.

(56) References Cited

FOREIGN PATENT DOCUMENTS

| | | | |
|---|---|---|---|
| JP | 6-167880 | | 6/1994 |
| JP | 11143190 A | * | 5/1999 |
| JP | 2011-33706 | | 2/2011 |

OTHER PUBLICATIONS

Takeda et al. (JP 11-143190 A), May 1999, JPO Machine Translation.*

* cited by examiner

*Primary Examiner* — David Gray
*Assistant Examiner* — Erika J Villaluna
(74) *Attorney, Agent, or Firm* — Nixon & Vanderhye P.C.

(57) ABSTRACT

A toner discharging device has a toner containing section, a toner discharging member, and a toner discharging section. The toner discharging section has a toner discharge port formed by opening a vertically lower part of the cylindrical wall. The toner discharging member has a rotation axis; a toner discharge plate fixed to the rotation axis at a position facing the discharge port in the vicinity of one end of the discharging section and vertically above the discharge port; an elastic helical blade being fixed, to the discharge plate and being stretchable in a direction of the rotation axis; and a helical blade section having a helical blade fixed to the rotation axis over an area in the vicinity of another end of the discharging section and an area within the containing section where the discharge plate and the elastic helical blade are not formed.

10 Claims, 8 Drawing Sheets

TONER DISCHARGING DEVICE, TONER CARTRIDGE AND IMAGE FORMING APPARATUS

CROSS-REFERENCE TO RELATED APPLICATION

This application is related to Japanese Patent Application No. 2011-152045 filed on Jul. 8, 2011, whose priority is claimed under 35 USC §119, and the disclosures of which are incorporated by reference in its entirety.

BACKGROUND OF THE INVENTION

1. Field of the Invention

The present invention relates to a toner discharging device and a toner cartridge. More particularly, the present invention relates to a toner discharging device and a toner cartridge to be used in an image forming apparatus that performs image formation with the use of a two-component developer including a toner and a magnetic carrier.

2. Description of the Related Art

In a conventional developing device for containing and supplying, to a photoconductor drum, a two-component developer including a toner and a magnetic carrier, toner is supplied from a toner cartridge to the developing device when the toner in the developing device runs low due to consumption by image formation and the toner concentration in the two-component developer is detected to be lower than a specified value.

For example, there has been used a developer supplying container comprising: a main body for containing a developer; a supply port provided in the bottom of the main body for supplying the developer; a conveyance path for conveying the developer toward the supply port; and a conveyance screw provided in the conveyance path, the conveyance screw including a screw axis and a spiral fin, wherein the conveyance screw is rotated about the screw axis thereby to convey the developer toward the supply port and supply the developer to a developing device through the supply port (see Japanese Unexamined Patent Application Publication No. 2011-033706).

Japanese Unexamined Patent Application Publication No. 2011-033706 discloses an embodiment in which the conveyance screw has a first region located just before the supply port and a second region located at an upstream side relative to the first region, the diameter of the spiral fin in the first region is smaller than the diameter of the spiral fin in the second region, and the conveyance screw further includes, at a position adjoining the spiral fin in the first region and facing the supply port, a protruding spatula extending in the axial direction of the screw axis.

In the developer supplying container disclosed in Japanese Unexamined Patent Application Publication No. 2011-033706, the conveyance screw has the two regions different in the diameter of the spiral fin and includes a protruding spatula near the supply port so that the toner conveyance ability in the first region just before the supply port is less than the toner conveyance ability in the second region, and therefore the supply is not decreased to ensure a predetermined supply.

However, in conventional toner supplying devices and the supplying container disclosed in Japanese Unexamined Patent Application Publication No. 2011-033706, the toner staying around the supply port for discharging the toner to an exterior collides with the toner conveyed thereto through the conveyance path, and some toner is compressed and aggregated there, having nowhere else to go.

In particular, when having been transported over a long distance or having been left over a long period of time under a high-temperature environment and therefore having a reduced flowability, the toner cannot be discharged from the supply port smoothly to raise the probability that the toner is compressed and aggregated there.

SUMMARY OF THE INVENTION

The present invention is a toner discharging device comprising: a toner containing section for containing a toner; a toner discharging member for conveying the toner contained in the toner containing section; and a toner discharging section having a cylindrical wall and accommodating a part of the toner discharging member in an internal space defined by the wall, the toner discharging section having a toner discharge port formed by opening a vertically lower part of the cylindrical wall, the toner discharging member comprising: a rotation axis extended in the same direction as a longitudinal direction of the cylindrical wall; a toner discharge plate fixed to the rotation axis at a position facing the toner discharge port in the vicinity of one end of the toner discharging section and vertically above the toner discharge port; an elastic helical blade being fixed, at one end thereof, to the toner discharge plate and being stretchable in a direction of the rotation axis; and a helical blade section having a helical blade fixed to the rotation axis over an area in the vicinity of another end of the toner discharging section and an area within the toner containing section where the toner discharge plate and the elastic helical blade are not formed, wherein the toner discharge plate, the elastic helical blade and the helical blade section are rotated around the rotation axis thereby to convey the toner contained in the toner containing section toward the toner discharge port.

According to this configuration, it is possible to steadily convey the toner that has reached the toner discharging section toward the toner discharge port by means of the toner discharge plate and the elastic helical blade. Even when the toner temporarily stays around the toner discharge port, it is possible to reduce pressure on the toner to prevent toner aggregation, because the elastic helical blade stretchable in the direction of the rotation axis facilitates conveyance of the toner staying around the toner discharge port in a circumferential direction of the rotation axis.

DESCRIPTION OF THE PREFERRED EMBODIMENTS

Figure 1:
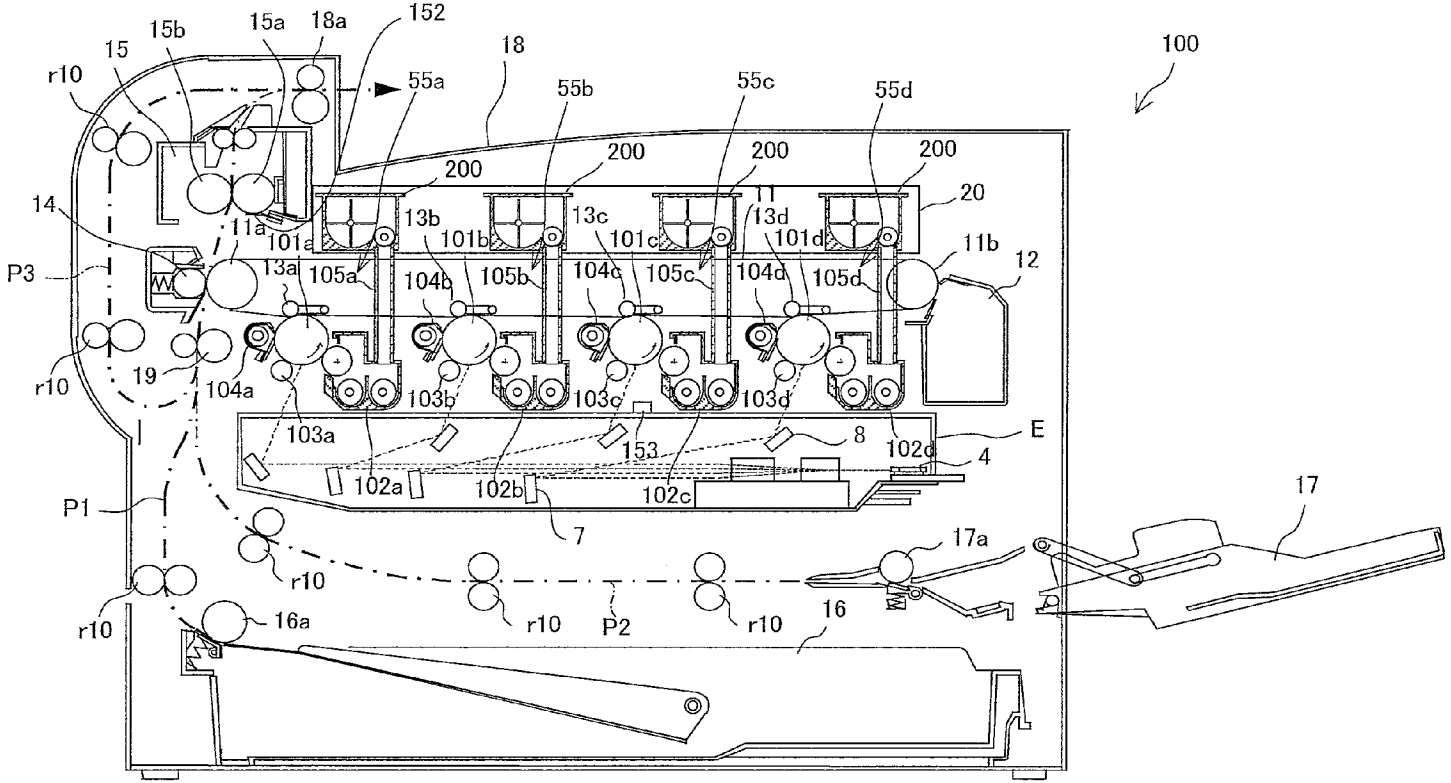
FIG. 1 is an explanatory diagram illustrating a general configuration of an embodiment of an image forming apparatus of the present invention.

The present invention provides a toner discharging device and a toner cartridge capable of preventing toner aggregation by devising a configuration of a conveyance member for conveying the toner.

In the toner discharging device of the present invention, the elastic helical blade may be extended in the direction of the rotation axis to the vicinity of the helical blade section, and when the elastic helical blade is in its original size, another end of the elastic helical blade is in contact with one end of the helical blade section, so that the elastic helical blade and the helical blade section integrally form a continued helical shape.

According to this configuration, it is possible to prevent local accumulation of the toner, because the toner is conveyed toward the toner discharge port by the blades in the continued helical shape.

In the toner discharging device of the present invention, the elastic helical blade may be separated from the rotation axis by a predetermined gap except for the end fixed to the toner discharge plate.

According to this configuration, the gap between the elastic helical blade and the rotation axis can reduce friction of the elastic helical blade, when stretching, against the rotation axis to prevent fusing and aggregation of the toner due to frictional heat.

In the toner discharging device of the present invention, the toner discharging section may further include a shutter provided under the toner discharge port for covering an opening area of the toner discharge port, and opening and shutting the toner discharge port, and while the shutter is open, the toner conveyed in the same direction as the rotation axis to the vicinity of the toner discharge port by the helical blade section and the elastic helical blade is further conveyed toward the toner discharge port by the toner discharge plate to be discharged to the outside of the device through the toner discharge port.

In the toner discharging device of the present invention, the elastic helical blade may stretch or contract in the direction of the rotation axis when the toner conveyed to the toner discharging section is in an amount greater than a predetermined amount, in a mass having a size larger than a predetermined size or in a state of having a hardness greater than a predetermined hardness.

According to this configuration, it is possible to prevent accumulation of the toner around the toner discharging section and to reduce extra pressure on the toner to further prevent toner aggregation, because the elastic helical blade stretches or contracts in the direction of the rotation axis according to the state of the toner conveyed thereto.

The present invention is a toner cartridge comprising: any one of the toner discharging device; and a toner containing section having a tubular space for containing the toner.

According to this configuration, it is possible to provide a toner cartridge capable of supplying a less aggregated toner.

According to another aspect of the present invention, there is provided an image forming apparatus comprising: a photoconductor drum having a surface on which an electrostatic latent image is formed; a charger for charging the surface of the photoconductor drum; an exposure device for forming the electrostatic latent image on the surface of the photoconductor drum; a developing device for supplying a toner to the electrostatic latent image formed on the surface of the photoconductor drum to form a toner image; a toner supplying device for supplying a toner to the developing device; a transfer device for transferring, onto a recording medium, the toner image formed on the surface of the photoconductor drum by the developing device; and a fixing device for fixing the toner image onto the recording medium, wherein the toner supplying device is the toner cartridge.

Since this configuration allows supply of a less aggregated toner, it is possible to form stable images for a long period of time.

According to the present invention, the toner discharge plate and the stretchable elastic helical blade are provided in the vicinity of the toner discharging section having the toner discharge port, and the elastic helical blade stretchable in the direction of the rotation axis facilitates conveyance of the toner staying around the toner discharge port in a circumferential direction of the rotation axis. Accordingly, it is possible to reduce pressure on the toner to prevent toner aggregation even when the toner temporarily stays around the toner discharge port.

Hereinafter, the best mode for carrying out the present invention will be described with reference to the drawings. It should be noted that the present invention is not limited thereto.

<Configuration of Image Forming Apparatus of Present Invention>

FIG. 1 is a configuration diagram of an embodiment of an image forming apparatus including a developing device of the present invention.

As illustrated in FIG. 1, an image forming apparatus 100 of the present invention mainly comprises: a photoconductor drum 101 having a surface on which an electrostatic latent image is formed; a charge roller (charging device) 103 for charging the surface of the photoconductor drum 101; an exposure unit (exposure device) E for forming an electrostatic latent image on the surface of the photoconductor drum 101; a developing device 102 for supplying a toner to the electrostatic latent image on the surface of the photoconductor drum 101 to form a toner image; a toner supplying device (toner cartridge) 200 for supplying a toner to the developing device 102; a transfer unit (transfer device) for transferring the toner image on the surface of the photoconductor drum 101 to a recording medium via an intermediate transfer belt 11; and a fixing unit (fixing device) 15 for fusing the toner image onto the recording medium.

The image forming apparatus 100 forms a multicolor or monochromatic image on a predetermined sheet (recoding paper, recoding medium) according to image data transmitted from an exterior via a communications network. The image forming apparatus 100 may be equipped with a scanner or the like in an upper part thereof.

First, a general configuration of the image forming apparatus 100 will be described.

The image forming apparatus 100 illustrated in FIG. 1 forms multicolor images or monochromatic images, and handles image data for each of four color components of black (K), cyan (C), magenta (M) and yellow (Y). In the image forming apparatus, a black image, a cyan image, a magenta image and a yellow image are formed separately, and the images of the respective color components are superimposed to form one multicolor image.

As illustrated in FIG. 1, therefore, the image forming apparatus 100 is provided with four developing devices 102 (102*a*, 102*b*, 102*c*, 102*d*), four photoconductor drums 101 (101*a*, 101*b*, 101*c*, 101*d*), four charge rollers 103 (103*a*, 103*b*, 103*c*, 103*d*), four cleaning units 104 (104*a*, 104*b*, 104*c*, 104*d*) and four primary transfer rollers 13 (13*a*, 13*b*, 13*c*, 13*d*) so as to form images of the respective color components.

In other words, the image forming apparatus 100 is provided with four image formation stations (image forming sections 55*a* to 55*d*) each including one developing device 102, one photoconductor drum 101, one charge roller 103 and one cleaning unit 104 and one primary transfer roller 13.

The reference numeral a represents members for black image formation, the reference numeral b represents members for cyan image formation, the reference numeral c represents members for magenta image formation, and the reference numeral d represents members for yellow image formation.

In addition, the image forming apparatus 100 includes the exposure unit E, the fixing device 15, sheet conveyance paths (P1, P2 and P3), a toner cartridge unit 20, a sheet feed cassette 16, a manual sheet feed tray 17 and a sheet exit tray 18.

The charge roller 103 is to uniformly charge the surface of the photoconductor drum 101 at a predetermined potential.

Other than a contact roller type charger shown in FIG. 1, a contact brush type charger, a non-contact charger type charger, or the like may be used as the charge roller 103.

As illustrated in FIG. 1, the exposure unit E is a laser scanning unit (LSU) that includes a laser irradiation section and reflective mirrors. Other than the laser scanning unit, an EL (electroluminescence) or LED writing head in which light emitting elements are arranged in an array may be used as the exposure unit E. The exposure unit E exposes the charged photoconductor drum 101 with light according to image data input to form an electrostatic latent image according to the image data on the surfaces of the photoconductor drum 101.

The exposure unit E includes a semiconductor laser, not shown, a polygon mirror 4, a first reflection mirror 7 and a second reflection mirror 8, and applies light beams such as laser beams modulated according to the image data of a black hue, a cyan hue, a magenta hue and a yellow hue to the photoconductor drums 101*a* to 101*d*, respectively in the case of multicolor image formation. Thereby, electrostatic latent images according to the image data of the black hue, the cyan hue, the magenta hue and the yellow hue are formed on the photoconductor drums 101*a* to 101*d*, respectively.

The photoconductor drum 101 is a substantially cylindrical image carrier disposed above the exposure unit E, and driven and controlled by drive means and control means, not shown, so as to rotate in a predetermined direction. The photoconductor drum 101 is composed of a base material and a photoconductive layer formed on the base material. For example, a photoconductive layer of amorphous silicon (a-Si), selenium (Se), an organic photo-semiconductor (OPC) or the like is formed into a thin film on a peripheral surface of a metal dram made of aluminum as a base material. It should be however noted that the photoconductor drum 101 is not particularly limited to the above-mentioned configuration.

The developing device 102 (102*a*, 102*b*, 102*c* and 102*d*) supplies a toner to the surface of the photoconductor drum 101 and makes visible (develops) an electrostatic latent image formed on the photoconductor drum 101 with a K, C, M or Y toner.

The developing device 102 includes, in its upper part, a toner transport mechanism 105 (toner supply pipes 105*a*, 105*b*, 105*c*, 105*d*) and the toner cartridge 200.

The toner cartridge 200 includes a toner discharging device and a toner containing section as will be described later.

The developing devices 102*a* to 102*d* contain a black toner, a cyan toner, a magenta toner and a yellow toner, respectively, and develop electrostatic latent images of the respective hues formed on the photoconductor drums 101*a* to 101*d* into a black toner image, a cyan toner image, a magenta toner image and a yellow toner image, respectively.

The cleaning unit 104 removes and collects toner left on the surface of the photoconductor drum 101 after development and image transfer processes.

The transfer unit is disposed above the photoconductor drum 101. The transfer unit includes the primary transfer rollers 13 (13*a*, 13*b*, 13*c*, 13*d*), the intermediate transfer belt 11, a driving roller 11*a*, a driven roller 11*b*, a secondary transfer roller 14 for transferring, to a paper sheet, a toner image transferred on the intermediate transfer belt 11 and an intermediate transfer belt cleaning unit 12.

The primary transfer rollers 13, the driving roller 11*a* and the driven roller 11*b* allow the intermediate transfer belt 11 to lay across in a tensioned condition and rotationally drive the intermediate transfer belt 11.

As the intermediate transfer belt 11 rotates, an external peripheral surface thereof meets the photoconductor drum 101*d*, the photoconductor drum 101*c*, the photoconductor drum 101*b* and the photoconductor drum 101*a* in this order.

The primary transfer rollers 13*a* to 13*d* are disposed in positions facing the respective photoconductor drums 101*a* to 101*d* via the intermediate transfer belt 11. The positions where the intermediate transfer belt 11 meets the photoconductor drums 101*a* to 101*d* are primary transfer positions. The intermediate transfer belt 11 is formed of a film having a thickness of approximately 100 to 150 μm into an endless form.

A primary transfer bias having a polarity reverse to the charge polarity of the toner is applied to the primary transfer rollers 13*a* to 13*d* by constant voltage control in order to transfer toner images carried on the surfaces of the photoconductor drums 101*a* to 101*d* to the intermediate transfer belt 11. Thereby, the toner images of the respective colors formed on the photoconductor drum 101 (101*a* to 101*d*) are transferred and superimposed sequentially on the external peripheral surface of the intermediate transfer belt 11 to form a full-color toner image on the external peripheral surface of the intermediate transfer belt 11.

When image data of only one, two or three colors out of yellow, magenta, cyan and black are input, the electrostatic latent image formation and the toner image formation are performed only in the photoconductor(s) 101 corresponding to the color(s) of the input image data out of the four photoconductor drums 101*a* to 101*d*. For example, in the case of monochromatic image formation, the electrostatic latent image formation and the toner image formation are performed only in the photoconductor drum 101*a* corresponding to the black color, and only a black toner image is transferred onto the external peripheral surface of the intermediate transfer belt 11.

The primary transfer rollers 13*a* to 13*d* are each composed of a metal (for example, stainless steel) shaft having a diameter of 8 to 10 mm coated with a conductive elastomer (for example, EPDM or foamed urethane). The primary transfer rollers 13*a* to 13*d* uniformly apply a high voltage to the intermediate transfer belt 11 by means of the conductive elastomer. While the primary transfer rollers 13*a* to 13*d* are used as transfer electrodes in the present embodiment, a brush may be used alternatively.

After transferred onto the external peripheral surface of the intermediate transfer belt 11 at each primary transfer position, each toner image is conveyed by the rotation of the intermediate transfer belt 11 to a secondary transfer position where the intermediate transfer belt 11 meets the secondary transfer roller 14. In the image formation, the secondary transfer roller 14 is pressed at a predetermined nip pressure to contact with the external peripheral surface of the intermediate transfer belt 11 whose internal peripheral surface is in contact with a peripheral surface of the driving roller 11*a*. In order to steadily obtain the nip pressure, one of the secondary transfer roller 14 and the driving roller 11*a* is formed from a hard material such as a metal, and the other is formed from a flexible material such as the case with an elastic roller (for example, elastic rubber roller or formable resin roller).

When a paper sheet fed from the sheet feed cassette 16 or the manual sheet feed tray 17 passes between the secondary transfer roller 14 and the intermediate transfer belt 11, a voltage for transferring the toner image onto the paper sheet is applied to the secondary transfer roller 14. This voltage is a high voltage having a polarity (+) reverse to the charge polarity (−) of the toner.

As described above, the electrostatic latent images on the photoconductor drum 101 (101*a* to 101*d*) are individually made visible with the toners corresponding to the respective color components to be toner images. The toner images are superimposed on the intermediate transfer belt 11. The superimposed toner images are moved by the rotation of the intermediate transfer belt 11 to a contact position between the intermediate transfer belt 11 and a paper sheet that has been conveyed to this position, and transferred from the external peripheral surface of the intermediate transfer belt 11 onto the paper sheet by the secondary transfer roller 14 disposed at this position.

Toners adhering to the intermediate transfer belt 11 due to the contact between the intermediate transfer belt 11 and the photoconductor drum 101, and toners that have not been transferred upon the transfer of the toner images from the intermediate transfer belt 11 to the paper sheet and that are remaining on the intermediate transfer belt 11 cause color mixture of the toners in a following process. Such toners are therefore removed and collected by the intermediate transfer belt cleaning unit 12.

The intermediate transfer belt cleaning unit 12 includes a cleaning blade in contact with the intermediate transfer belt 11 as a cleaning member, for example. The intermediate transfer belt 11 is supported by the driven roller 11*b* from the back side at a part contacting with the cleaning blade.

The fixing device 15 includes a heat roller 15*a* and a pressure roller 15*b*, and the heat roller 15*a* and the pressure roller 15*b* rotate with a sheet therebetween. The heat roller 15*a* is controlled by a control section, not shown, so as to be at a predetermined fixing temperature. The control section controls the temperature of the heat roller 15*a* based on detection signals from a temperature detector, not shown.

The paper sheet on which the toner image has been transferred as a visible image is guided to the fixing device 15 including the heat roller 15*a* and the pressure roller 15*b* and passes between the heat roller 15*a* and the pressure roller 15*b* to be heated and pressurized. Thereby, the toner image as the visible image is fixed solid on the paper sheet. The paper sheet on which the toner image has been fixed is ejected onto the sheet exit tray 18 by sheet ejection rollers 18*a*.

The image forming apparatus 100 is provided with the sheet conveyance path P1 in a substantially vertical direction for sending paper sheets contained in the sheet feed cassette 16 to the sheet exit tray 18 via between the secondary transfer roller 14 and the intermediate transfer belt 11, and then the fixing device 15.

Along the sheet conveyance path P1, there are disposed a pickup roller 16*a* for sending out the paper sheets in the paper sheet cassette 16 into the sheet conveyance path P1 one by one, conveyance rollers r10 for conveying upward a paper sheet sent out, a registration roller 19 for guiding the paper sheet to between the secondary transfer roller 14 and the intermediate transfer belt 11 with a predetermined timing and the sheet ejection rollers 18*a* for ejecting the paper sheet to the sheet exit tray 18.

The image forming apparatus 100 also includes the sheet conveyance path P2 from the manual sheet feed tray 17 to the registration roller 19, along which a pickup roller 17*a* and conveyance rollers r10 are disposed.

The image forming apparatus 100 further includes the sheet conveyance path P3 from the sheet ejection rollers 18*a* to an upstream side of the registration roller 19 in the sheet conveyance path P1.

The conveyance rollers r10 are small-size rollers provided along the sheet conveyance paths for facilitating and assisting the sheet conveyance.

The pickup roller 16*a* is a pull-in roller provided at an end of the sheet feed cassette 16 for feeding paper sheets from the sheet feed cassette 16 to the sheet conveyance path P1 one by one. The pickup roller 17*a* is a pull-in roller provided in the vicinity of the manual sheet feed tray 17 for feeding paper sheets from the manual sheet feed tray 17 to the sheet conveyance path P2 one by one.

The registration roller 19 is to temporarily hold a paper sheet being conveyed through the sheet conveyance path and convey the paper sheet to a transfer part in such a timely manner that a front end of the toner image on the intermediate transfer belt 11 and a front end of the paper sheet coincide.

The sheet ejection rollers 18*a* are rotatable in normal and reverse directions and driven to rotate in the normal direction to eject a paper sheet to the sheet exit tray 18 in one-side image formation in which an image is formed on one side of the paper sheet or in the second image formation in double-side image formation in which images are formed on both sides of the paper sheet.

In the first image formation in the double-side image formation, on the other hand, the sheet ejection rollers 18*a* are driven to rotate in the normal direction until a back end of the paper sheet passes the fixing device 15, and then driven to rotate in the reverse direction while keeping the back end of the paper sheet therebetween to guide the paper sheet to the sheet conveyance path P3. Thereby, the paper sheet having completed image formation on one side thereof in the double-side image formation is guided to the sheet conveyance path P1 with the front and back sides and the front and back ends reversed.

The registration roller 19 guides a paper sheet fed from the sheet feed cassette 16 or the manual sheet feed tray 17 or conveyed through the sheet conveyance path P3 to between the secondary transfer roller 14 and the intermediate transfer belt 11 in synchronization with the rotation of the intermediate transfer belt 11. The registration roller 19 is therefore stopped from rotating when the operation of the photoconductor drum 101 and the intermediate transfer belt 11 is started, so that the paper sheet fed or conveyed prior to the rotation of the intermediate transfer belt 11 is stopped from moving through the sheet conveyance path P1 with the front end thereof being in contact with the registration roller 19.

Thereafter, the registration roller 19 is allowed to start rotating when the front end of the paper sheet faces the front end of the toner image formed on the intermediate transfer belt 11 at a position where the secondary transfer roller 14 is in pressed contact with the intermediate transfer belt 11.

In the case of full-color image formation in which all the image formation sections 55*a* to 55*d* perform image formation, all the primary transfer rollers 13*a* to 13*d* press the intermediate transfer belt 11 against the photoconductor drums 101*a* to 101*d*. In the case of monochromatic image formation in which only the image formation section 55*a* performs image formation, only the primary transfer roller 13*a* presses the intermediate transfer belt 11 against the photoconductor drum 101*a*.

<Description of Sheet Conveyance Operation>

Next, the sheet conveyance operation by the sheet conveyance paths will be described.

In the image forming apparatus 100 illustrated in FIG. 1, paper sheets of a predetermined size are placed beforehand in the sheet feed cassette 16 and the manual sheet feed tray 17 to be used when printing is performed on a small number of sheets.

The pickup rollers (16*a*, 17*a*) respectively disposed in the vicinity of the cassette and the tray (16, 17) feed the paper sheets to the sheet conveyance path one by one.

In the case of one-side printing, a paper sheet fed from the sheet feed cassette 16 is conveyed to the registration roller 19 by the conveyance rollers r10 in the sheet conveyance path P1, and then conveyed to the transfer part (contact position between the transfer roller 14 and the intermediate transfer belt 11) by the registration roller 19 in such a timely manner that a front end of the paper sheet and a front end of the toner image as superimposed on the intermediate transfer belt 11 coincide.

At the transfer part, the toner image is transferred onto the paper sheet, and the toner image is fixed onto the paper sheet by means of the fixing device 15. Thereafter, the paper sheet is ejected onto the sheet exit tray 18 by the sheet ejection rollers 18*a*.

When fed from the manual sheet feed tray 17, the paper sheet is conveyed to the registration roller 19 by the plurality of conveyance rollers r10. Thereafter, the paper sheet is conveyed in the same manner as in the paper sheet fed from the sheet feed tray 16 to be ejected onto the sheet exit tray 18.

In the case of double-side printing, on the other hand, a back end of the paper sheet having completed printing on one side thereof and passed through the fixing device 15 as described above is held by the sheet ejection rollers 18*a*.

Next, the paper sheet is guided to the conveyance rollers r10 by the reverse rotation of the sheet ejection rollers 18*a*, passes the registration roller 19 again, undergoes printing on the other side, and then ejected to the sheet exit tray 18.

<Toner Cartridge (Toner Supplying Device)>

Next, a configuration of an embodiment of the toner cartridge 200 of the present invention will be described in detail with reference to the drawings.

Figure 2:
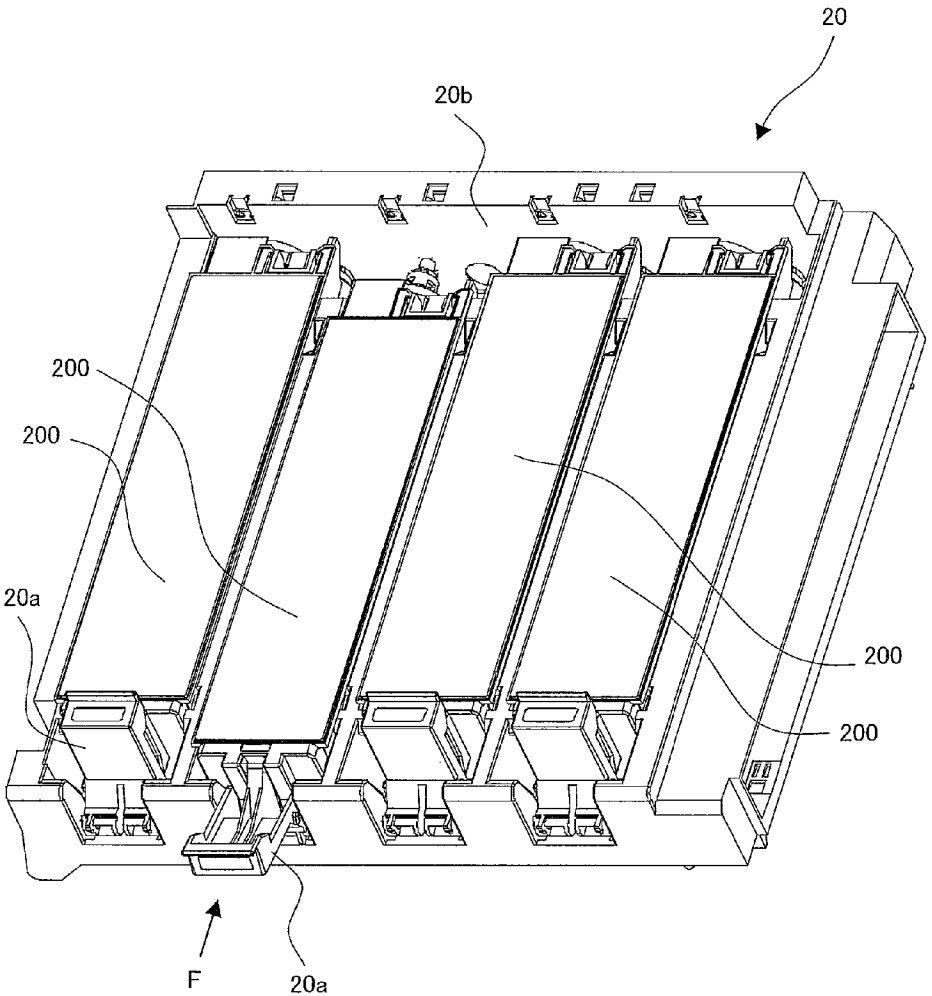
FIG. 2 is a perspective view of a toner cartridge unit including toner cartridges to be mounted in the image forming apparatus illustrated in FIG. 1.
Figure 3A:
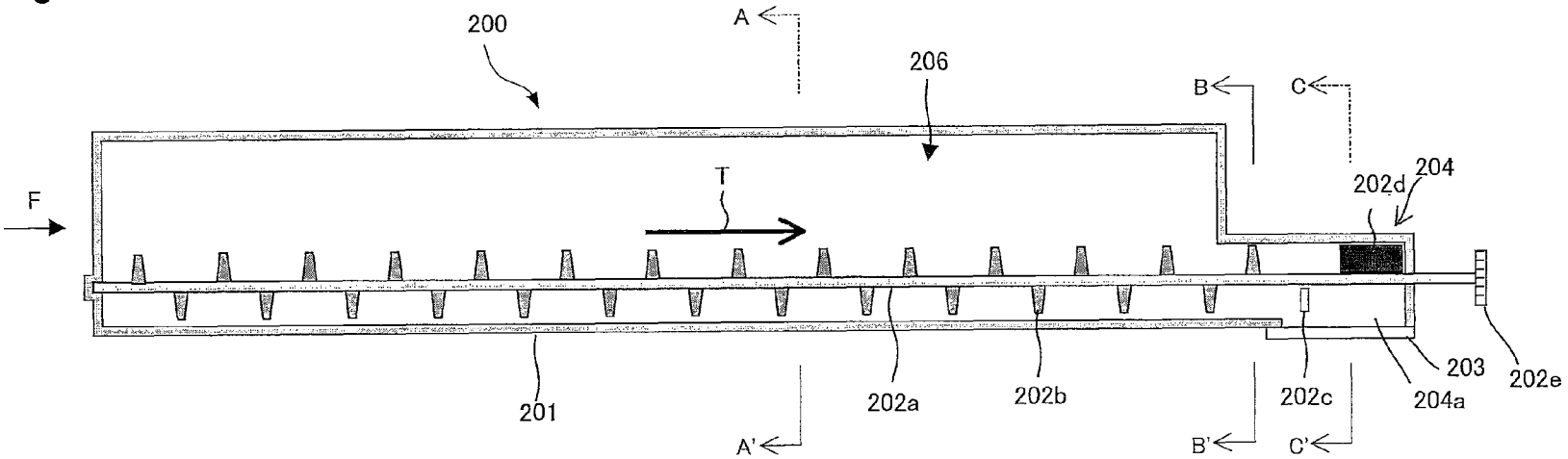
FIG. 3A is a side sectional view of a toner cartridge 200.
Figure 3B:
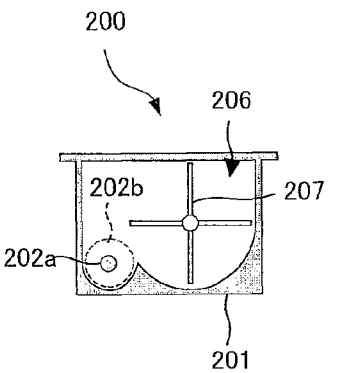
FIG. 3B is a sectional view of the toner cartridge 200 taken along a line A-A' in FIG. 3A.
Figure 3C:
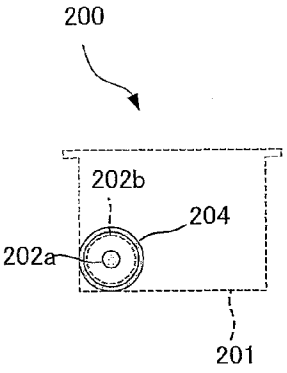
FIG. 3C is a sectional view of the toner cartridge 200 taken along a line B-B' in FIG. 3A.
Figure 3D:
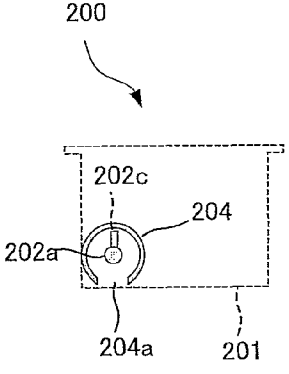
FIG. 3D is a sectional view of the toner cartridge 200 taken along a line C-C' in FIG. 3A.

FIG. 2 is a perspective view of a toner cartridge unit including toner cartridges to be mounted in an image forming apparatus according to the present embodiment; FIG. 3A is a side sectional view of the toner cartridge 200; FIG. 3B is a sectional view of the toner cartridge 200 taken along a line A-A' in FIG. 3A; FIG. 3C is a sectional view of the toner cartridge 200 taken along a line B-B' in FIG. 3A; and FIG. 3D is a sectional view of the toner cartridge 200 taken along a line C-C' in FIG. 3A.

Figure 4:
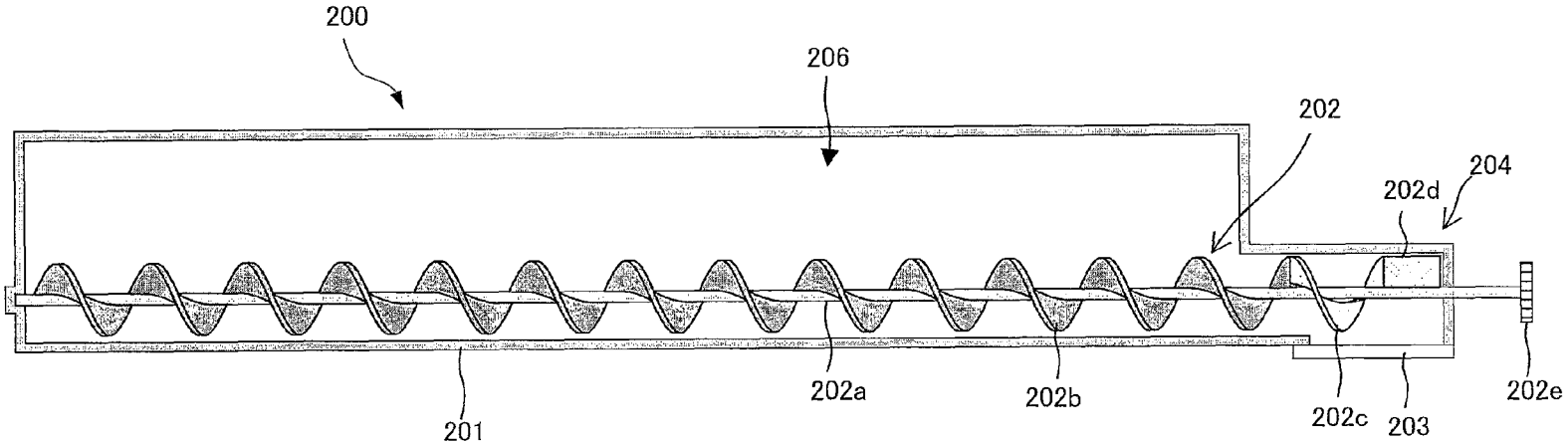
FIG. 4 is a side view of a toner discharging member 202 disposed in the toner cartridge 200.
Figure 5:
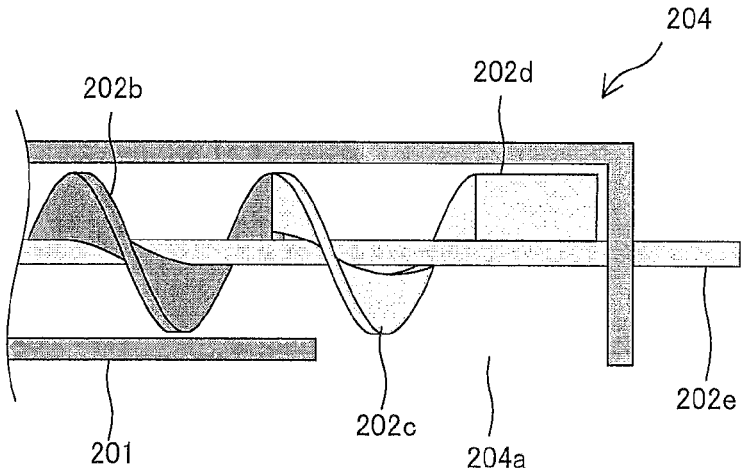
FIG. 5 is an enlarged view of major portions around an elastic helical blade 202*c* of the toner discharging member 202 illustrated in FIG. 4.
Figure 6:
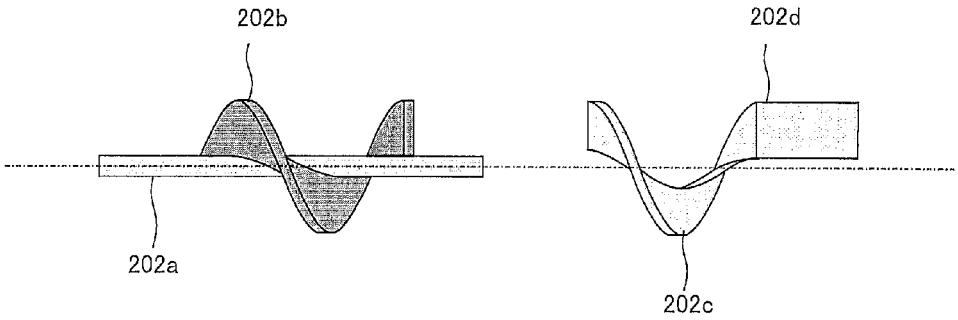
FIG. 6 is an exploded view illustrating a helical blade section 202*b* and the elastic helical blade 202*c* when separated.
Figure 7:
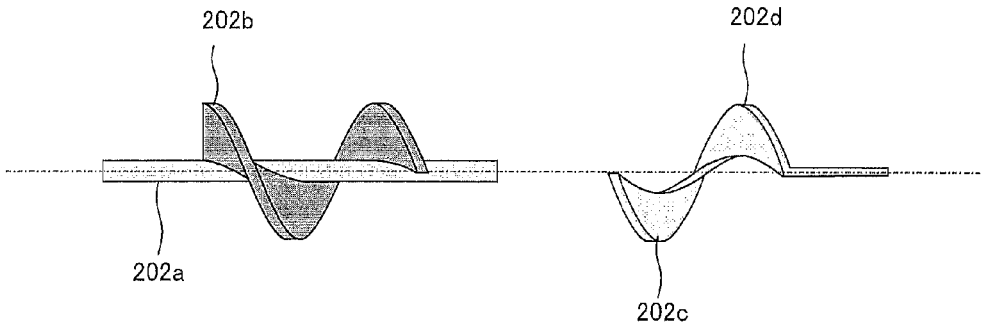
FIG. 7 is an exploded view illustrating the helical blade 202*b* and the elastic helical blade 202*c* illustrated in FIG. 6 when rotated 90° about a rotation axis.

FIG. 4 is a side view of a toner discharging member 202 disposed in the toner cartridge 200. FIG. 5 is an enlarged view of major portions around an elastic helical blade 202*c* of the toner discharging member 202 illustrated in FIG. 4. FIG. 6 is an exploded view illustrating a helical blade section 202*b* and the elastic helical blade 202*c* when separated. FIG. 7 is an exploded view illustrating the helical blade section 202*b* and the elastic helical blade 202*c* illustrated in FIG. 6 when rotated 90° about a rotation axis.

In FIG. 2, four toner cartridges 200 are placed side by side in the toner cartridge unit 20.

As illustrated in FIG. 2, each toner cartridge 200 is maintained with a toner containing section 201 illustrated in FIG. 3 being pressed against a stopper plate 20*b* by lifting a lock lever 20*a* and thereby shifting the toner containing section 201 rightward (in an arrow F direction).

As illustrated in FIG. 3A, each toner cartridge 200 mainly includes a toner discharging device and the toner containing section 201 having a tubular space for containing a toner.

The toner containing section 201 (also referred to as toner container) is a container in the form of a rectangular cylinder for containing a toner and accommodates most of the toner discharging member 202 for conveying the toner in the container toward a toner discharge port.

The toner discharging device mainly includes the toner discharging member 202 and the toner discharging section 204.

The toner discharging member 202 is a member for conveying the toner contained in the toner containing section 201. The toner discharging section 204 has a cylindrical wall and accommodates a part of the toner discharging member 202 in an internal space defined by the wall.

The toner discharging member 202 conveys the toner contained in the toner containing section 201 on the left side of FIG. 3A in an arrow T direction and includes a rotation axis 202*a* rotatably attached to a wall of the toner container 201 and a wall of the toner discharging section 204.

The toner discharging section 204 discharges the toner conveyed in the arrow T direction in FIG. 3A by means of the toner discharging member 202 to the outside of the toner cartridge 200.

The toner discharging section 204 is formed integrally with an external wall of the toner containing section 201 and has a cylindrical space projected from a right end of the toner containing section 201 as illustrated in FIG. 3A, for example.

The toner discharging section 204 includes a toner discharge port 204*a* opened in a curved surface of an inner wall of its cylindrical shape as illustrated in FIGS. 3C and 3D.

The toner discharge port 204*a* is formed in an area in the vicinity of a vertically lower part (bottom) of the wall surface of the cylindrical shape as illustrated in FIG. 3D. The toner discharge port 204*a* is a quadrangular opening, for example, through which the toner conveyed is discharged to the outside of the toner cartridge.

The toner discharge port 204*a* has a shutter 203 at a lower part thereof for opening and shutting the toner discharge port 204*a* as illustrated in FIG. 3A.

The shutter 203 is slid in the horizontal direction so as to expose the toner discharge port 204*a* as the toner cartridge 200 is mounted in the toner cartridge unit 20 and moved in the arrow F direction in FIG. 2.

The shutter 203 is a flat plate-like member provided for covering the entire opening area of the toner discharge port 204*a*, and for opening and shutting the toner discharge port. The shutter 203 is placed in a position for shutting the toner discharge port 204*a* before the toner cartridge 200 is mounted in the toner cartridge unit 20.

In addition, the shutter 203 is formed so as to be in contact with the toner supply pipe 105 disposed under the toner discharge port 204*a* to be opened once the toner cartridge 200 is mounted in the toner cartridge unit 20.

While the shutter 203 is open, the toner conveyed in the same direction as the rotation axis 202*a* to the vicinity of the toner discharge port by the helical blade section 202*b* and the elastic helical blade 202*c* is further conveyed toward the toner discharge port 204*a* by the rotation of a toner discharge plate 202*d* around the rotation axis to be discharged to the outside of the toner cartridge through the toner discharge port 204*a*.

<Toner Discharging Member>

As illustrated in FIG. 3A, the toner discharging member 202 mainly includes the rotation axis 202*a*, the helical blade section 202*b*, the elastic helical blade 202*c*, the toner discharge plate 202*d* and a driving gear 202*e*.

As illustrated in FIG. 3A, the rotation axis 202*a* is a bar-like member extended from the left side surface of the toner containing section 201 to the right side surface of the toner discharging section 204. Furthermore, as illustrated in FIGS. 3C and 3D, the rotation axis 202*a* is extended in the same direction as the longer direction of the wall of the cylindrical shape of the toner discharging section 204 and placed on and along the center line of the cylindrical inner wall.

The toner discharging member 202 rotates around the center line of the cylindrical inner wall to convey the toner contained in the toner containing section 201 toward the toner discharge port 204*a* (in the arrow T direction in FIG. 3A).

The helical blade section 202*b* and the toner discharge plate 202*d* are fixed to the rotation axis 202*a*.

The elastic helical blade 202*c* is not directly fixed to the rotation axis 202*a* but attached to the toner discharge plate 202*d* as will be described later. The elastic helical blade 202*c* is a member stretchable in a direction of the rotation axis.

The helical blade section 202*b* has a plurality of helical blades arranged on and fixed to the rotation axis 202*a* in an area within the toner containing section 201 and in an area around one end of the toner discharging section 204.

In other words, the helical blades are arranged on and fixed to the rotation axis 202*a* in the areas not having the toner discharge plate 202*d* and the elastic helical blade 202*c*.

In addition, as illustrated in FIG. 3A, the rotation axis 202*a* is formed to penetrate the right side surface of the toner discharging section 204 and have the driving gear 202*e* fixed to the right end thereof.

The driving gear 202*e* is driven by a drive control section, not shown, to rotate the helical blade section 202*b*, the elastic helical blade 202*c* and the toner discharge plate 202*d* around the rotation axis 202*a* thereby to convey the toner toward the toner discharge port.

As illustrated in FIG. 4, the helical blade section 202*b* has rigid helical blades fixed around the rotation axis 202*a* and rotates integrally with the rotation axis 202*a* to convey the toner in the toner containing section 201 toward the toner discharge port 204*a*.

As illustrated in FIG. 3A, the toner containing section 201 accommodates most of the toner discharging member 202. Further, as illustrated in FIG. 3B, the toner containing section 201 includes a toner containing space 206 and a toner conveyance member 207.

The toner containing space 206 stores toner to be supplied to the toner discharging member 202. The toner conveyance member 207 is a stirring member having a rotation axis and, in its circumference direction, blades each formed of an elastic sheet having the substantially same width as the toner containing space 206. The toner conveyance member 207 rotates to supply the toner to the toner discharging member 202 while stirring the toner. Thus, the toner in the toner containing space 206 is conveyed to the vicinity of the toner discharging member 202 by the toner conveyance member 207, and further conveyed in the arrow T direction in FIG. 3A by the rotation of the helical blade section 202*b* of the toner discharging member 202.

The toner discharge plate 202*d* is a rectangular flat plate fixed to the rotation axis 202*a* at an end of the toner discharging member 202 facing the toner discharge port 204*a* at a downstream side of the toner conveyance direction.

As illustrated in FIGS. 3A and 4, the toner discharge plate 202*d* is attached to the rotation axis 202*a* in the vicinity of one end, that is, in the vicinity of the right side surface of the toner discharging section 204 and right above the toner discharge port 204*a*.

In addition, the toner discharge plate 202*d* is a rectangular flat plate having shorter sides in a direction from the rotation axis 202*a* toward the cylindrical inner wall of the toner discharging section 204 and longer sides in the axial direction of the rotation axis 202*a*, of which the shorter sides have a length slightly shorter than the distance between the rotation axis 202*a* and the cylindrical inner wall. For example, the toner discharge plate 202*d* and the cylindrical inner wall have a gap of approximately 0.5 mm therebetween.

The toner discharge plate 202*d* having the above-described configuration rotates integrally with the rotation axis 202*a* thereby to turn the toner conveyed to the toner discharging section 204 in the circumferential direction of the rotation axis 202*a*.

That is, the toner discharge plate 202*d* changes the conveyance direction of the toner conveyed thereto from the arrow T direction in FIG. 3A to the vertical descent direction to guide the toner to the toner discharge port 204*a*.

As illustrated in FIGS. 4 and 5, the elastic helical blade 202*c* is an elastic member having a helical blade stretchable in the direction of the rotation axis and fixed to the toner discharge plate 202*d* at one end thereof.

The elastic helical blade 202*c* is rotated integrally with the toner discharge plate 202*d* as the toner discharge plate 202*d* rotates around the rotation axis 202*a* to convey the toner toward the right end of the toner discharging section 204 and toward the toner discharge port 204*a*.

As illustrated in FIGS. 3A and 5, the elastic helical blade 202*c* is fixed to the toner discharge plate 202*d* at one end thereof. Except for this end, the elastic helical blade 202*c* is not fixed to the rotation axis 202*a* so as to be separated from the rotation axis 202*a* by a predetermined gap.

The gap is to reduce frictional heat to be generated by the friction of the elastic helical blade 202*c* against the rotation axis 202*a* when the elastic helical blade 202*c* stretches and contracts, and may be approximately 0.5 mm, for example.

In addition, as illustrated in FIG. 5, the elastic helical blade 202*c* is extended in the direction of the rotation axis to the vicinity of the helical blade section 202*b* and disposed so that an end of the elastic helical blade 202*c* (left end of the blade 202*c* in FIG. 5) and an end of the helical blade section 202*b* (right end of the helical blade section 202*b* in FIG. 5) are in contact to integrally form a continued helical shape while the blade 202*c* is not stretching or contracting.

In FIG. 6, the elastic helical blade 202*c* and the helical blade section 202*b* are separated for an illustrative purpose. As can be understood from the drawing, the elastic helical blade 202*c* is not connected to the rotation axis 202*a* and the helical blade section 202*b* but just fixed to the toner discharge plate 202*d*.

That is, when the toner is conveyed in a normal condition, the elastic helical blade 202*c* and the helical blade section

202*b* integrally form a continued helical shape to convey the toner toward the toner discharge port.

Here, the normal condition means that the toner is not aggregated and conveyed with a flowability expected at the time of the designing, that is, the elastic helical blade 202*c* is not loaded.

FIGS. 5 and 6 show that the elastic helical blade 202*c* and the helical blade section 202*b* are in contact when the toner discharge plate 202*d* comes to a vertically upper position in the normal condition, for example.

When the helical blade section 202*b* and the toner discharge plate 202*d* fixed to the rotation axis 202*a* are rotated 90° from the position shown in FIGS. 5 and 6 in the normal condition, the elastic helical blade 202*c* is also rotated 90° while keeping the helical shape integrally formed with the helical blade section 202*b* as illustrated in FIG. 7.

That is, when the toner is conveyed with an expected flowability, the elastic helical blade 202*c* does not suffer from extra load to covey the toner toward the toner discharge port 204*a* while keeping the helical shape continued from the helical blade section 202*b* as illustrated in FIG. 5.

On the other hand, when the toner is aggregated and reduced in the flowability to generate a greater load than the normal condition, that is, for example, when the toner conveyed to the toner discharging section is in an amount greater than a predetermined amount, in a mass having a size larger than a predetermined size or in a state of having a hardness greater than a predetermined hardness, the elastic helical blade 202*c* stretches or contracts in the direction of the rotation axis.

Figure 8:
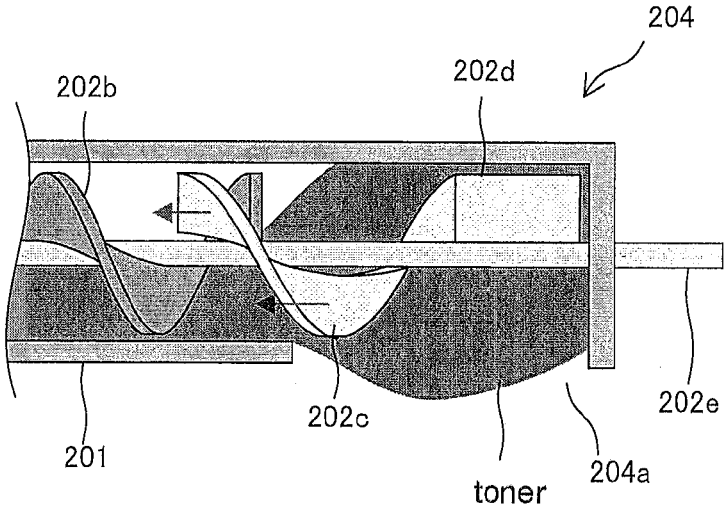
FIG. 8 is a conception diagram illustrating the elastic helical blade 202*c* in a stretching state.

For example, when the toner expected to be discharged from the toner discharge port 204*a* is temporarily stuck due to mild aggregation (reversible aggregation that can be easily resolved), the toner conveyed by the elastic helical blade 202*c* will be blocked by the toner staying around the toner discharge plate 202*d* to become stuck. When the toner discharging section 204 is filled with the toner thus stuck, the toner is compressed. Then, the reaction force generated when the elastic helical blade 202*c* compresses the toner gives the elastic helical blade 202*c* a load in its stretching direction. Given the load, the elastic helical blade 202*c* deforms as illustrated in FIG. 8, stretching leftward along the rotation axis 202*a* (in a direction of arrows in FIG. 8). As a result, the compressive force is relieved temporarily to avoid severe aggregation (irreversible aggregation that cannot be easily resolved) of the toner due to a strong compressive force on the toner.

In addition, while the elastic helical blade 202*c* is stretching as illustrated in FIG. 8, the force for conveying the toner in the direction of the rotation of the rotation axis is increased but the force for conveying the toner in the direction of the rotation axis is reduced to produce a compressive force reducing effect.

Thereafter, as the temporary mild aggregation of the toner is resolved and the toner around the toner discharge port 204*a* is gradually discharged, the amount of the toner around the toner discharge plate 202*d* and the elastic helical blade 202*c* decreases to allow the elastic helical blade 202*c* to return to its original shape by its elasticity. That is, the elastic helical blade 202*c* deforms in a direction opposite to the arrows in FIG. 8, contracting to return to its original helical shape continued from the helical blade section 202*b*.

When the elastic helical blade 202*c* deforms in its contracting direction as described above, the compressive force on the toner is relieved, and therefore the toner can be prevented from compaction and the toner discharging member 202 can be prevented from being locked with the toner stuck due to the compaction.

As described above, the elastic helical blade 202*c* ensures stable conveyance of the toner and prevents aggregation of the toner by stretching and contracting in the direction of the rotation axis with the rotation of the rotation axis. For appropriate aggregation prevention, it is necessary to select a material having an appropriate stretching and contracting rate (spring constant).

A preferable stretching and contracting rate cannot be determined unambiguously. Preferably, for example, the elastic helical blade 202*c* has a spring constant k of 0.01 or more and 0.1 or less.

The spring constant k (N/mm) is obtained from the expression $k=P/\delta$, wherein P is a load (N), and $\delta$ is a deflection (mm) in the direction of the rotation axis.

If the spring constant k is less than 0.01, the amount of the toner being conveyed is likely to be unstable. On the other hand, if the spring constant k is more than 0.1, it will be difficult to obtain the toner compression prevention effect.

More preferably, the elastic helical blade 202*c* has a spring constant k of 0.02 or more and 0.06 or less. Examples of the material of the elastic helical blade 202*c* having such a spring constant includes SUS spring materials.

What is claimed is:

1. A toner discharging device comprising:

a toner containing section for containing a toner;

a toner discharging member for conveying the toner contained in the toner containing section; and a toner discharging section having a cylindrical wall and accommodating a part of the toner discharging member in an internal space defined by the wall, the toner discharging section having a toner discharge port formed by opening a vertically lower part of the cylindrical wall, the toner discharging member comprising:

a rotation axis extended in the same direction as a longitudinal direction of the cylindrical wall;

a toner discharge plate fixed to the rotation axis at a position facing the toner discharge port in the vicinity of one end of the toner discharging section and vertically above the toner discharge port;

an elastic helical blade being fixed, at one end thereof, to the toner discharge plate and being stretchable in a direction of the rotation axis; and a helical blade section having a helical blade fixed to the rotation axis over an area in the vicinity of another end of the toner discharging section and an area within the toner containing section where the toner discharge plate and the elastic helical blade are not formed, wherein the toner discharge plate, the elastic helical blade and the helical blade section are rotated around the rotation axis thereby to convey the toner contained in the toner containing section toward the toner discharge port.

2. The toner discharging device according to claim 1, wherein the elastic helical blade is extended in the direction of the rotation axis to the vicinity of the helical blade section, and when the elastic helical blade is in its original size, another end of the elastic helical blade is in contact with one end of the helical blade section, so that the elastic helical blade and the helical blade section integrally form a continued helical shape.

3. The toner discharging device according to claim 1, wherein the elastic helical blade is separated from the rotation axis by a predetermined gap except for the end fixed to the toner discharge plate.

4. The toner discharging device according to claim 1, wherein the toner discharging section includes a shutter provided under the toner discharge port for covering an opening area of the toner discharge port, and opening and shutting the toner discharge port, and while the shutter is open, the toner conveyed in the same direction as the rotation axis to the vicinity of the toner discharge port by the helical blade section and the elastic helical blade is further conveyed toward the toner discharge port by the toner discharge plate to be discharged to the outside of the device through the toner discharge port.

5. The toner discharging device according to claim 1, wherein the elastic helical blade stretches or contracts in the direction of the rotation axis when the toner conveyed to the toner discharging section is in an amount greater than a predetermined amount, in a mass having a size larger than a predetermined size or in a state of having a hardness greater than a predetermined hardness.

6. A toner cartridge comprising:

the toner discharging device according to claim 1; and a toner containing section having a tubular space for containing the toner.

7. An image forming apparatus comprising the toner cartridge according to claim 6.

8. An image forming apparatus comprising:

a photoconductor drum having a surface on which an electrostatic latent image is formed;

a charger for charging the surface of the photoconductor drum;

an exposure device for forming the electrostatic latent image on the surface of the photoconductor drum;

a developing device for supplying a toner to the electrostatic latent image formed on the surface of the photoconductor drum to form a toner image;

a toner supplying device for supplying a toner to the developing device;

a transfer device for transferring, onto a recording medium, the toner image formed on the surface of the photoconductor drum by the developing device; and a fixing device for fixing the toner image onto the recording medium, wherein the toner supplying device is the toner cartridge according to claim 6.

9. The toner discharging device according to claim 1, wherein the elastic helical blade is not fixed to the rotation axis, and wherein the elastic helical blade can stretch and extend away from the discharge plate in a direction of the rotation axis.

10. The toner discharging device according to claim 9, wherein when the elastic helical blade stretches and extends away from the discharge plate in a direction of the rotation axis, an end of the elastic helical blade opposite the end fixed to the toner discharge plate overlaps a portion of the helical blade section.

* * * * *